US008051535B2

(12) United States Patent
Cheng

(10) Patent No.: US 8,051,535 B2
(45) Date of Patent: Nov. 8, 2011

(54) MAGNETIC DOORSTOP

(75) Inventor: Kun-Lung Cheng, Taichung (TW)

(73) Assignee: Donido Enterprise Co., Ltd., Taichung (TW)

( * ) Notice: Subject to any disclaimer, the term of this patent is extended or adjusted under 35 U.S.C. 154(b) by 302 days.

(21) Appl. No.: 12/546,623

(22) Filed: Aug. 24, 2009

(65) Prior Publication Data

US 2010/0277045 A1 Nov. 4, 2010

(30) Foreign Application Priority Data

Apr. 29, 2009 (TW) ..... 98207170 U

(51) Int. Cl.
*E05F 5/02* (2006.01)

(52) U.S. Cl. ..... 16/82; 16/320

(58) Field of Classification Search ..... 16/82, 86 A, 16/86 B, 86 R, 85, 320; 211/153, 182, 186–189, 211/134, 194, 181.1; 248/235, 245, 249, 248/300, 302, 188, 188.6; 312/111, 107, 312/108; 292/251.5, DIG. 15; 403/169, 403/171, 173, 170, 175, 176, 217, 218
See application file for complete search history.

(56) References Cited

U.S. PATENT DOCUMENTS

| | | | | |
|---|---|---|---|---|
| 2,519,435 | A * | 8/1950 | Byrd, Jr. | 292/251.5 |
| 3,025,559 | A * | 3/1962 | Basinger | 16/85 |
| 3,579,934 | A * | 5/1971 | Pietsch | 49/394 |
| 5,715,956 | A * | 2/1998 | Yoshida | 211/182 |
| 5,836,049 | A * | 11/1998 | Chiang | 16/82 |
| 5,918,998 | A * | 7/1999 | Pourmand | 403/218 |
| 6,321,411 | B1 * | 11/2001 | Ikejiri et al. | 16/82 |
| 6,588,811 | B1 * | 7/2003 | Ferguson | 292/251.5 |
| 6,718,709 | B2 * | 4/2004 | Sarkisyan et al. | 52/285.1 |
| 7,604,133 | B2 * | 10/2009 | Tsai | 211/194 |
| 2003/0145428 | A1 * | 8/2003 | Liao | 16/82 |
| 2005/0268433 | A1 * | 12/2005 | Seidler | 16/320 |

FOREIGN PATENT DOCUMENTS

| | | | |
|---|---|---|---|
| EP | 903458 | A1 * | 3/1999 |
| JP | 2000054714 | A * | 2/2000 |
| JP | 2003307069 | A * | 10/2003 |

* cited by examiner

*Primary Examiner* — Chuck Y. Mah

(74) *Attorney, Agent, or Firm* — Egbert Law Offices PLLC

(57) ABSTRACT

The present invention provides a magnetic doorstop, which is attached to the multidirectional joint of the existing sectional shelf. The doorstep includes a block type main part, which is of block type and has an mounting end and a holder; a clamp mouth, which is concave on the mounting end of the main part and displays a v-shape; and a magnetic part set on the holder of the main part. The magnetic doorstop can clamp the edge of corner recess of a multidirectional joint by the clamp mouth, and when the flexible door piece pivots to close, the magnetic part on the holder of the holding magnetic doorstop attracts the magnet at one corner of the frame bar of the flexible door piece and holds it. Thus, the flexible door piece can be held close.

5 Claims, 5 Drawing Sheets

MAGNETIC DOORSTOP

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a magnetic doorstop, and more particularly to an innovative doorstop, which can attach to the multidirectional joint of the existing sectional shelf.

2. Description of Related Art Including Information Disclosed Under 37 CFR 1.97 and 37 CFR 1.98.

The conventional fixed shelf for placing articles is of great size which cannot be disassembled in transit; thus, the sectional shelf structural configuration (hereinafter referred to simply as sectional shelf) is developed to handle this problem. In recent years, due to competition, the structural configurations of the sectional shelf on the market are various with diversified shelf materials or structures of shelves available for consumers' choice.

The sectional shelf of the present invention, particularly a structure formed by connecting a plurality of frame shelves with multidirectional joints, has the advantages of simple structure, easy assembly and optimum extensibility, so it wins a big market share and owns a large amount of users on the current sectional furniture market.

As stated above, the users of said sectional shelf are numerous, therefore, to satisfy diversified demands for use, the inventor is devoted to adding functions and values, such as adding a door piece. The mounting of door piece can enclose the compartment of the sectional shelf and meet some needs; however, once the door piece is added, how to mount the door piece on the existing sectional shelf and how to get it in proper place become problems. The existing sectional shelf structure should not be changed if possible; thus, the users of existing sectional shelf can assemble this door piece without the need of buying new sectional shelf.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the unique present invention, a magnetic doorstop comprises a block type main part, a clamp mouth and a magnetic part. The magnetic doorstop can clamp the edge of corner recess of a multidirectional joint assembled on the sectional shelf by the clamp mouth. When the flexible door piece pivots to close, the holding magnetic doorstop utilizes magnetic attraction to hold the door piece close. Thus, a magnetic doorstop with simple structure, easy assembly and optimum assembling strength can be supplied to attach to the sectional shelf and meet the diversified demands of users, achieving both the convenience for use and progress in technology.

There are improvements brought about by this invention.

Based on the structure of the present invention, there is a matching mounting end of the block type main part with a thickened part at the side of a corner recess set on the multidirectional joint. The structural strength of the mounting end can be enhanced, and the clamping strength and the stability of the clamp mouth at the end are raised, so it becomes more practical and durable.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
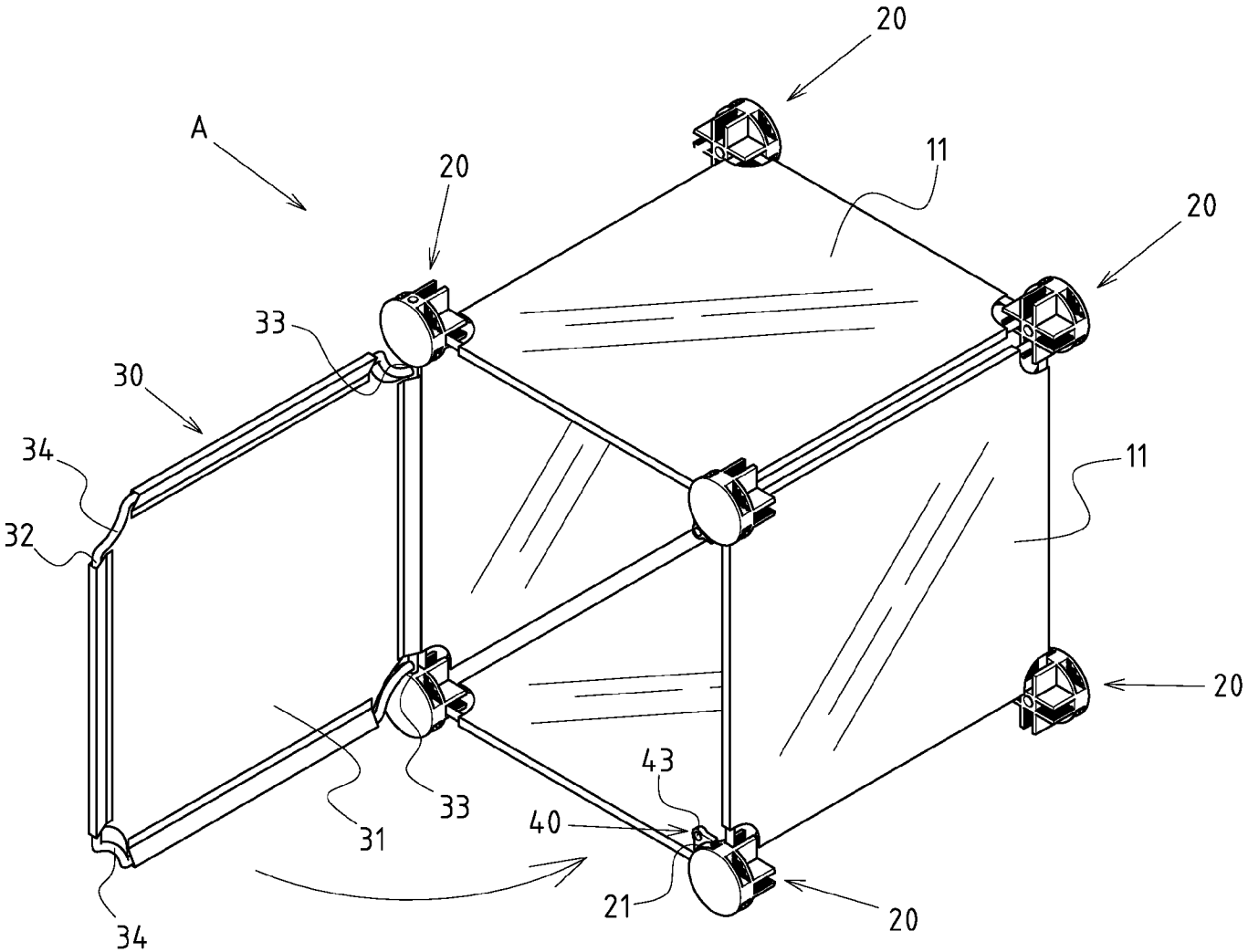
FIG. 1 shows a perspective view of the sectional shelf of the present invention.
Figure 2:
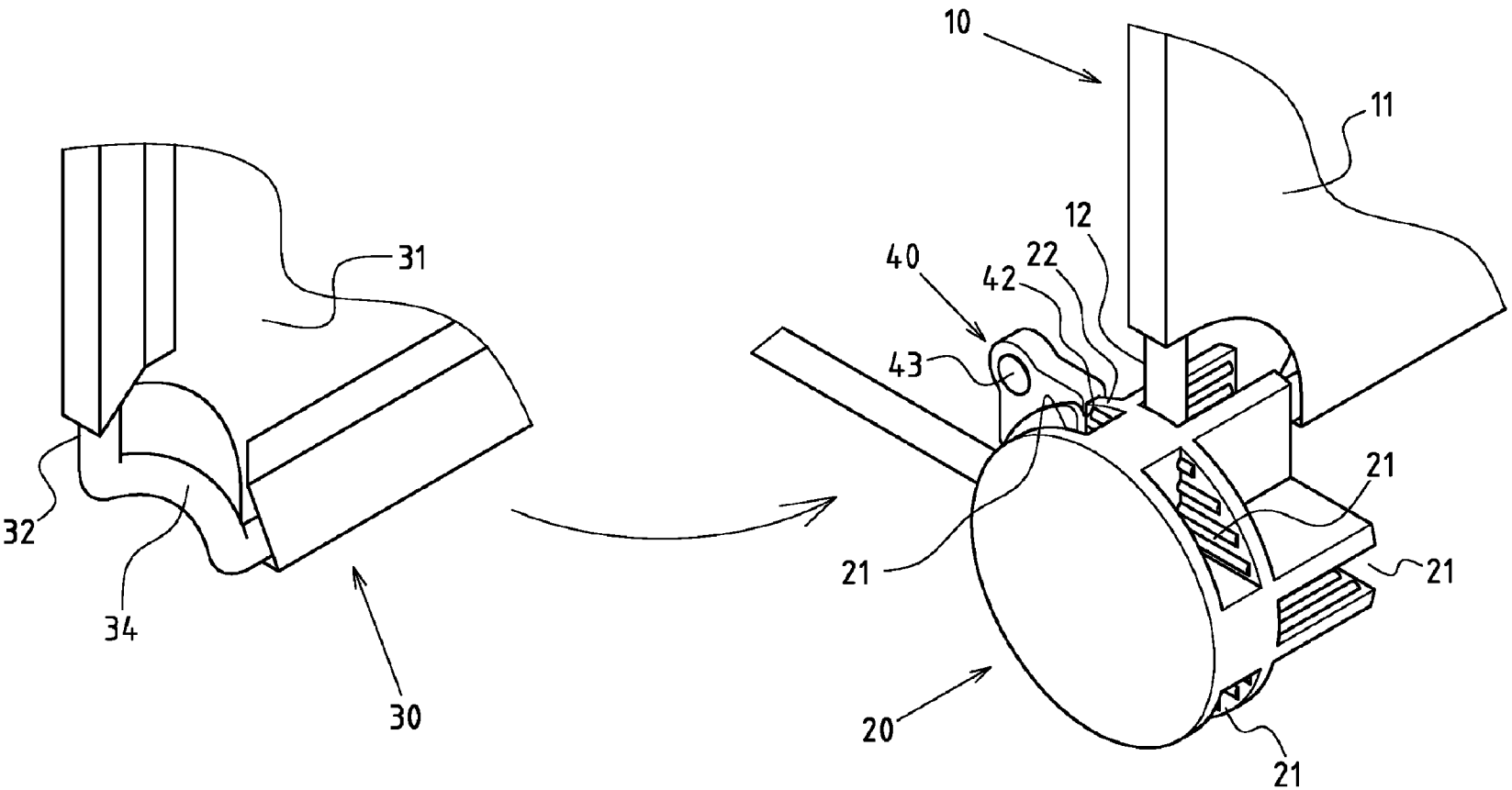
FIG. 2 shows a perspective view of the corresponding relationship between the holding magnetic doorstop and the magnetic part of the flexible door piece of the present invention.
Figure 3:
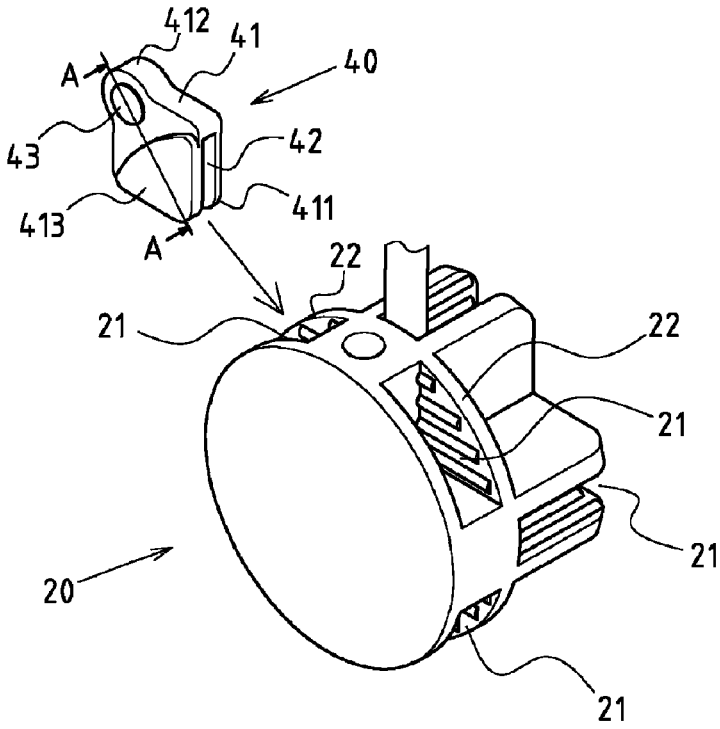
FIG. 3 shows an exploded perspective view of the holding magnetic doorstop and the multidirectional joint of the present invention.
Figure 4:
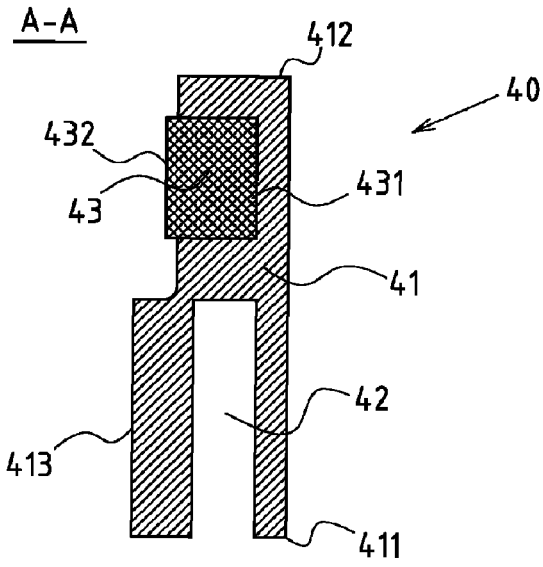
FIG. 4 shows an A-A sectional view of said holding magnetic doorstop revealed in FIG. 3.

FIGS. 1-4 depict preferred embodiments of a holding magnetic doorstop of the present invention and the sectional shelf where it is applied. The embodiments are provided for only explanatory purposes with respect to the patent claims.

The sectional shelf A comprises a plurality of sectional shelf boards 10, which each include a face plate 11 and several corner parts 12.

The shelf A also comprises a plurality of multidirectional joints 20, which have the multidirectional (e.g. cross, Pozidrive cross) corner recess 21 for inserting the corner parts 12 of corresponding sectional shelf boards. The corner recess 21 has an edge 22 at sides thereof.

There is a flexible door piece 30, which comprises of a door plate part 31, a frame bar 32 and a hinge 33 that may be protruding to hinge with the preset part (e.g. a slot) of the opposite multidirectional joint 20. In this way, the flexible door piece 30 can turn on the hinge 33 to open (see FIG. 1) or close. Also, at least one corner of the frame bar 32 has a magnet 34.

A magnetic doorstop 40 comprises: a block type main part 41, which is of block type and has an mounting end 411 and a holder 412; a clamp mouth 42, which is concave on the mounting end 411 of the main part 41 and displays a v-shape; and a magnetic part 43 (may be a strong magnet) set on the holder 412 of the main part 41.

The magnet 34 of the flexible door piece 30 is formed due to the magnetic metal (e.g. steel rod) adopted for the frame bar 32.

The magnetic part 43 has a insert end 431, which is inserted inside the holder 412 of the main part 41. A protruding end 432 protrudes at a proper height on the surface of the holder 412.

The mounting end 411 of the main part 41 corresponds to one side of the corner recess 21 of the multidirectional joint 20 and has a thickened part 413, whose structure is mainly for enhancing the structural strength of the mounting end 411 and thus raising the clamping strength and sturdiness of the clamp mouth 42.

Figure 6:
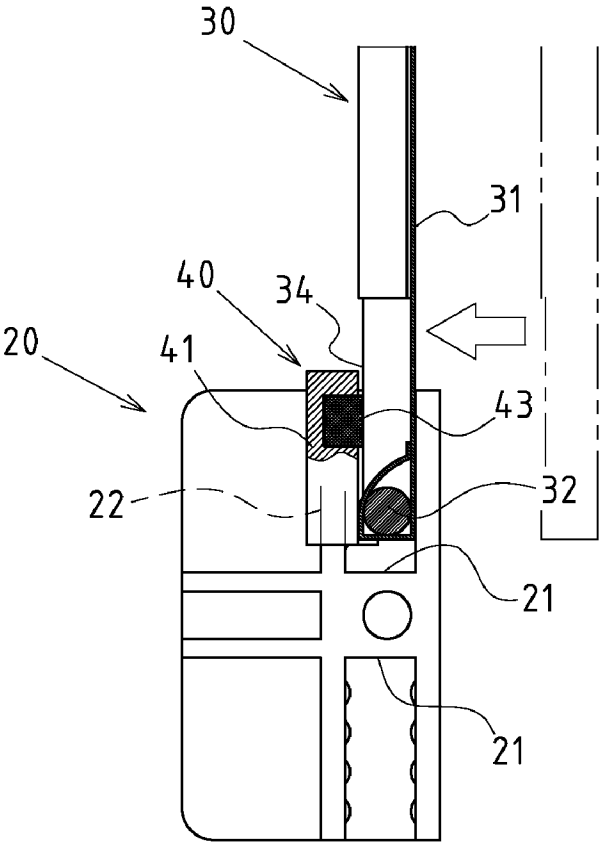
FIG. 6 shows a top plan view of the magnetic holding flexible door piece of the holding magnetic doorstop of the present invention from another perspective.
Figure 5:
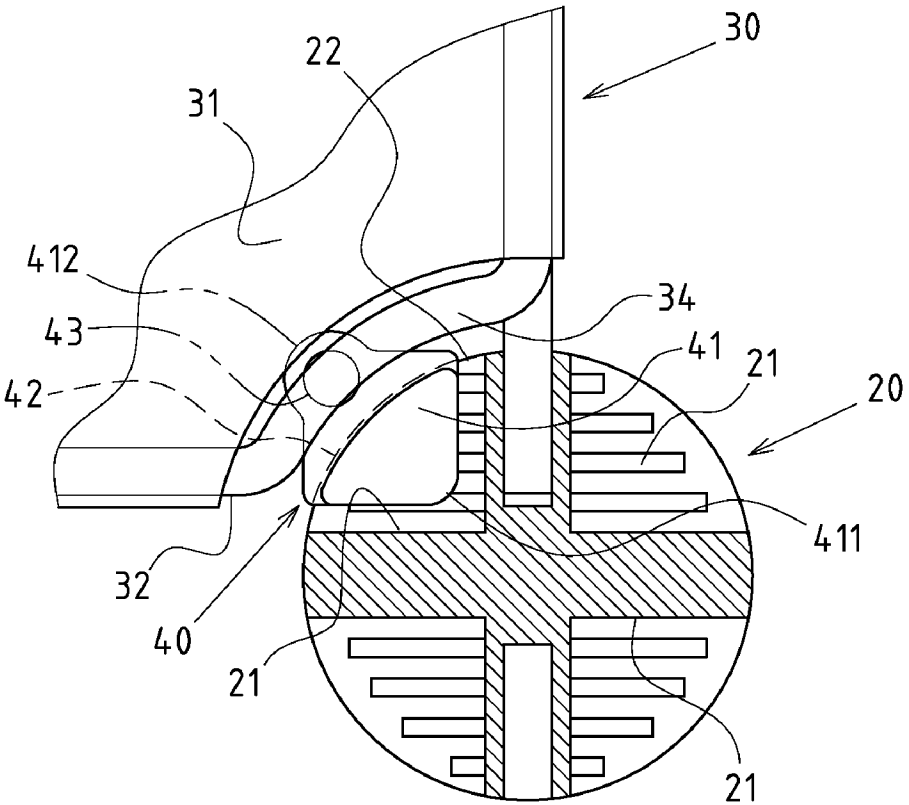
FIG. 5 shows a top plan view of the magnetic holding flexible door piece of the holding magnetic doorstop of the present invention.

Based on above-specified structure, the holding magnetic doorstop 40 of the present invention is characterized by that, it can attach to said sectional shelf A. Referring to FIGS. 1-4, the magnetic doorstop 40 can clamp the edge 22 of corner recess 21 of at least one multidirectional joint 20 assembled on the sectional shelf A by the clamp mouth 42, and a firm holding effect is obtained by this. When the flexible door piece 30 pivots to close (see FIGS. 5, 6), the magnetic part 43 on the holder 412 of the holding magnetic doorstop 40 attracts the magnet 34 at one corner of the frame bar 32 of the flexible door piece 30 and holds it, thus the flexible door piece 30 can be held close.

Figure 7:
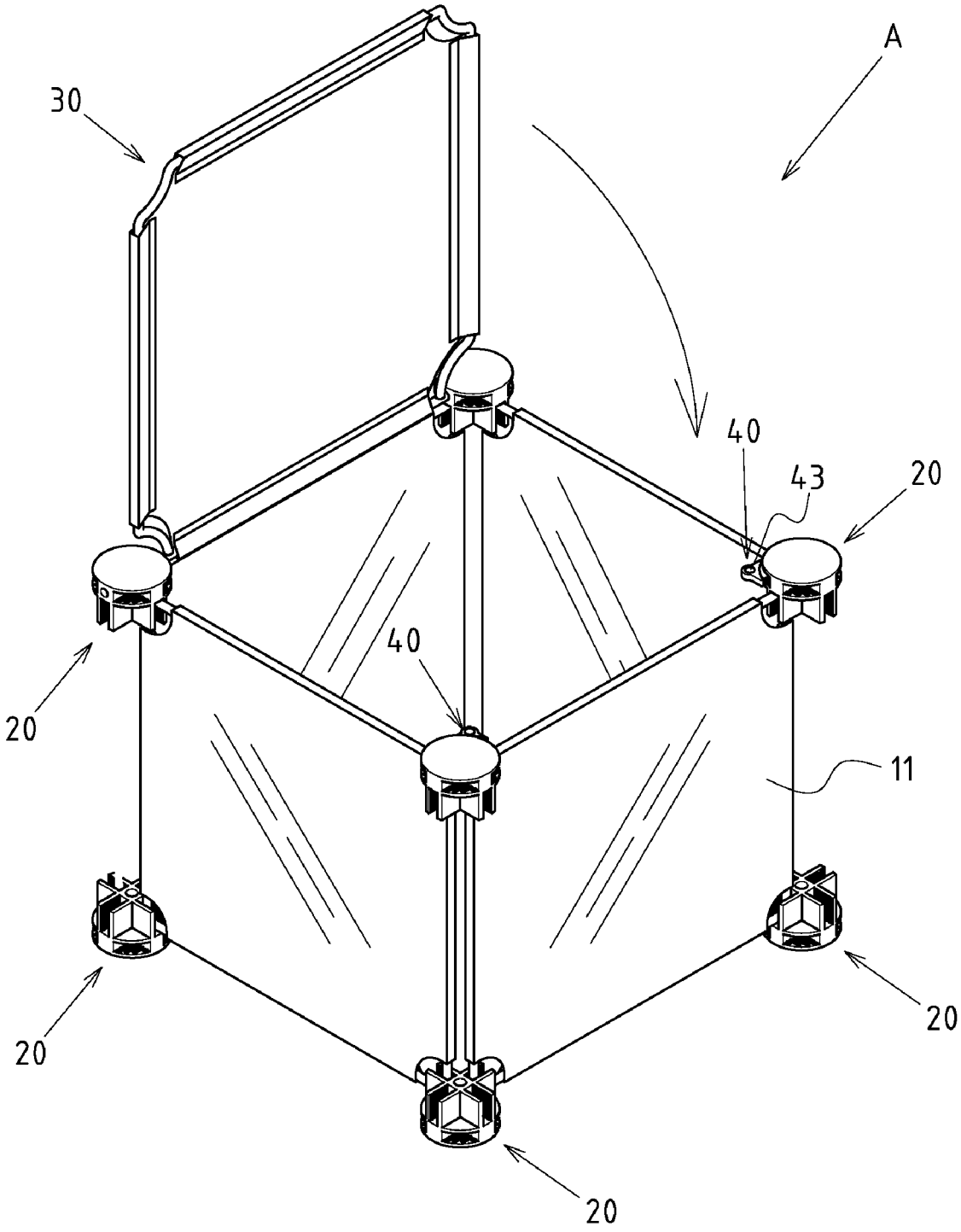
FIG. 7 shows another schematic view of an application of the flexible structure of the flexible door piece of the present invention.

Also, the flexible door piece 30 of said sectional shelf A can be either a side-open structure as shown in FIG. 1, or a top-open structure as the flexible door piece shown in FIG. 7. Based on the magnetic part, the magnetic doorstop 40 can turn another angle to upward hold.

To be further mentioned, the displayed model of said magnetic doorstop 40 on sale of the present invention can either be the model, which is assembled or co-packed with the sectional shelf A, or the model is independently sold as parts. Therefore, in the event that the structure of said holding magnetic doorstop 40 of the present invention is counterfeited, no matter it is independent parts or assembly with the sectional shelf A or a integrated package, it shall be covered in the scope defined by the patent application (as specified by the differences between the item 1 and item 4 of the scope of patent application).

I claim:

1. A magnetic doorstop for attaching to a multidirectional joint of an existing sectional shelf and magnetically holding the door piece of the sectional shelf, the magnetic door stop comprising:

a block type main part having a mounting end and an opposite end defining a holder;

a clamp mouth, said clamp mouth being concavely formed on the mounting end of the main part, said mounting end displaying a V-shape, and a magnetic part being set on the holder of the main part.

2. The door stop defined in claim 1, wherein the magnetic part has a insert end, being inserted inside the holder of the main part, and a protruding end, protruding at a proper height on the surface of the holder.

3. The door stop defined in claim 1, wherein the mounting end of the block type main part has a thickened part for enhancing the clamping strength and sturdiness of the clamp mouth.

4. A section shelf comprising, a plurality of sectional shelf boards, each shelf board having a face plate and several corner parts;

a plurality of multidirectional joints, each joint having a multidirectional corner recess for inserting the corner parts of corresponding sectional shelf boards, said corner recess having an edge at sides;

a flexible door piece, being comprised of a door plate part, a frame bar and a hinge protruding to hinge with an opposite multidirectional joint, the flexible door piece being pivotable on the hinge to open or close, at least one corner of the frame bar having a magnet; and a magnetic doorstop according claim 1, clamping an edge of corner recess of a multidirectional joint by the clamp mouth, when the flexible door piece pivots to close, the magnetic part on the holder attracting the magnet at one corner of the frame bar of the flexible door piece and holding the flexible door piece close.

5. The door stop as defined in claim 1, wherein the magnet of the flexible door piece is formed by a magnetic metal, wherein the magnetic metal is steel rod adapted to form the frame bar.

* * * * *